US005144876A

United States Patent [19]

Hirano

[11] Patent Number: 5,144,876

[45] Date of Patent: Sep. 8, 1992

[54] ELECTRONIC MUSICAL INSTRUMENT CAPABLE OF PERFORMING A TONE CONTROL RESPONSIVE TO AN AFTER-TOUCH OPERATION

[75] Inventor: Masashi Hirano, Hamamatsu, Japan

[73] Assignee: Yamaha Corporation, Hamamatsu, Japan

[21] Appl. No.: 531,031

[22] Filed: May 31, 1990

[30] Foreign Application Priority Data

Jun. 2, 1989 [JP] Japan ..... 1-141552

[51] Int. Cl.[5] ..... G10H 1/18

[52] U.S. Cl. ..... 84/658; 84/DIG. 7

[58] Field of Search ..... 84/615, 626, 658, 687-690, 84/DIG. 7; 341/27, 31-34

[56] References Cited

U.S. PATENT DOCUMENTS 4,195,545 4/1980 Nishimoto ..... 84/626
4,528,885 7/1985 Chihana ..... 84/626
4,979,423 12/1990 Watanabe ..... 84/690

FOREIGN PATENT DOCUMENTS 48-21282 6/1973 Japan .
54-43714 12/1979 Japan .
60-16960 5/1985 Japan .

*Primary Examiner*—Stanley J. Witkowski
*Attorney, Agent, or Firm*—Graham & James

[57] ABSTRACT

An electronic musical instrument includes a key-on information generation circuit for generating key-on information indicating depression of one of keys, an after-touch information generation circuit for generating after-touch information representing the state of a key operation subsequent to an initial touch on the key, a tone generator for generating a tone signal corresponding to the depressed key in response to the key-information, and a tone generation control circuit for controlling the tone generator so that a tone signal based on the depressed key is regenerated in response to the after-touch information. In one aspect of the invention, the tone generation control circuit includes a comparator for comparing the after-touch information with a predetermined value and controls the tone generator in accordance with a result of comparison by the comparator. A special effect such as trill can be imparted to a tone by regenerating it in response to the after-touch information.

6 Claims, 5 Drawing Sheets

ELECTRONIC MUSICAL INSTRUMENT CAPABLE OF PERFORMING A TONE CONTROL RESPONSIVE TO AN AFTER-TOUCH OPERATION

BACKGROUND OF THE INVENTION

This invention relates to an electronic musical instrument capable of performing a tone control by an after-touch operation on an operator designating a tone pitch such as a key in a keyboard.

There are electronic musical instruments having a keyboard and being capable of performing a tone control by an after-touch, i.e., a key operation subsequent to an initial touch on a key.

For example, Japanese Patent Publication No. 21282/1973 concerning an invention entitled "Effect tone control device in an electronic musical instrument" discloses a technique according to which musical effects such as vibrato and tremolo are imparted to a tone by an after-touch operation, Japanese Utility Model Publication No. 43714/1979 concerning an invention entitled "Tone control device for an electronic musical instrument" discloses a technique according to which tone volume of one of two tone source signals is controlled by an after-touch operation and the two tone source signals are mixed together for propagation as a sound, and Japanese Utility Model Publication No. 16960/1985 concerning an invention entitled "Automatic rhythm performance device" discloses a technique according to which tempo, rhythm pattern, rhythm tone color etc. are changed by an after-touch operation.

In these prior art tone control devices using an after-touch operation, start of generation of a tone relies entirely on an initial touch on a key, and changing in tone volume and tone color and imparting of effects such as vibrato and tremolo by an after-touch operation are limited to the tone generated by the initial touch on the key. In the rhythm producing electronic musical instrument, what is realized by an after-touch operation is limited to change in a rhythm pattern.

It is an object of the invention to provide an electronic musical instrument capable of regenerating a tone relating to a depressed key by an after-touch operation and thereby capable of simulating a performance technique of a high degree in a natural musical instrument.

SUMMARY OF THE INVENTION

The electronic musical instrument achieving the above described object of the invention comprises keys, key-on information generation means associated with said keys for generating key-on information indicating depression of one of said keys, after-touch information generation means associated with said keys for generating after-touch information representing the state of a key operation subsequent to an initial touch on said key, tone generation means for generating a tone signal corresponding to said key in response to the key-on information, and tone generation control means for controlling said tone generation means so that a tone signal based on said key is regenerated in response to the after-touch information.

According to the invention, key-on information and after-touch information are obtained in response to operation of an operator such as a key designating a tone pitch in a keyboard. The after-touch information is expressed by an amount of physical change indicating the state of operation of the operator, e.g., an amount of displacement of the operator, velocity of the operator or pressure applied to the operator. The tone generation control means produces both a tone control signal for generating a tone in response to the key-on information and a tone control signal for regenerating another tone in response to the after-touch information. The tone generation means starts generation of a tone in response to the key-on information and regenerates a tone in response to the after-touch information provided by the tone generation control means.

In one aspect of the invention, there is provided an electronic musical instrument wherein said tone generation control means comprises threshold value data setting means for setting threshold value data for the after-touch information, comparison means for comparing the threshold value data set by said threshold value data setting means with the after-touch information, and tone regeneration means for regenerating the tone based on said key in accordance with a result of comparison by said comparison means.

According to this aspect of the invention, a threshold value for the after-touch information is set by the threshold value data setting means. In the tone generation control means, the comparison means compares the threshold value with the value of the after-touch information and a tone generation control signal responsive to the after-touch information is obtained when the value of the after-touch information has exceeded the threshold value. The tone generation means therefore regenerates a tone in response to the after-touch touch information when the value of the after-touch information has exceeded the threshold value.

According to the invention, a tone is generated by the initial touch of an operator such as a key in a keyboard and a tone is regenerated by the after-touch operation of the operator whereby special performance techniques peculiar to keyboard instruments, rubbed string instruments and percussions can be readily simulated. Examples of such special performances are listed below:

(a) A trill which is a stroke operation repeating depression and release of a key can be performed by an after-touch operation whereby the performance effect can be improved.

(b) A performance peculiar to rubbed string instruments, e.g., an expression of a rhythm with an accent by bowing, can be simulated by an after-touch operation.

(c) Regeneration of a tone by an after-touch in a rhythm tone source can be realized. For example, the first tone is generated by an initial touch and the second tone which has been changed in its rudiment, e.g., roll or flam, is generated by an after-touch.

BRIEF DESCRIPTION OF DRAWINGS

In the accompanying drawings.

DESCRIPTION OF PREFERRED EMBODIMENTS

Preferred embodiments of the invention will now be described with reference to the accompanying drawings.

Figure 1:
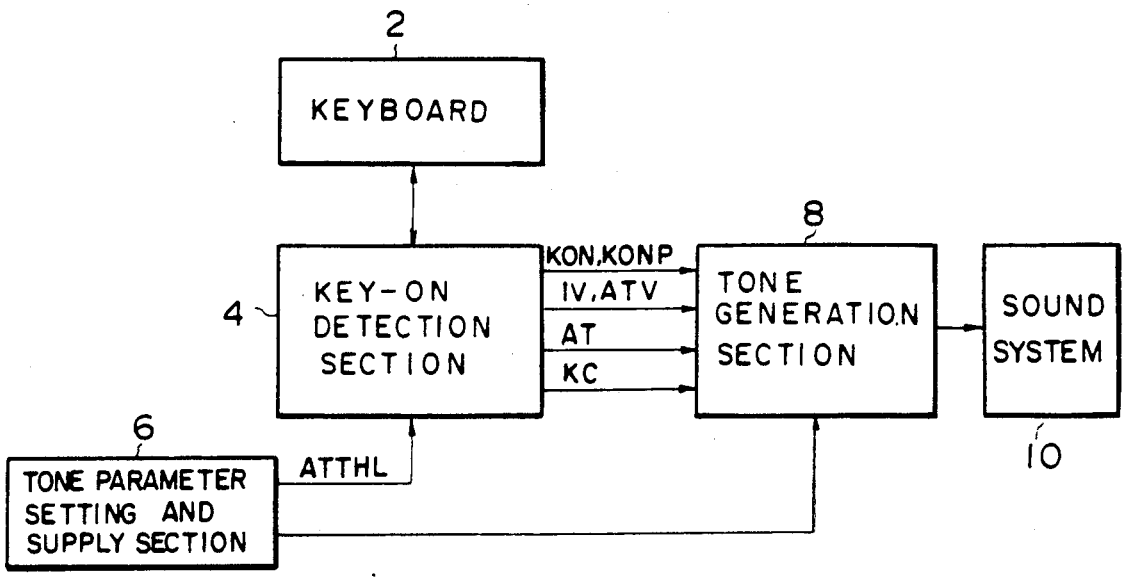
FIG. 1 a block diagram showing an embodiment of the electronic musical instrument according to the invention.

FIG. 1 shows an embodiment of the electronic musical instrument of the invention.

A keyboard 2 has a device for detecting the state of key operation which produces two level signals of a high level (H) and a low level (L) as a key is depressed and also produces pressure data in response to an after-touch operation.

Figure 2:
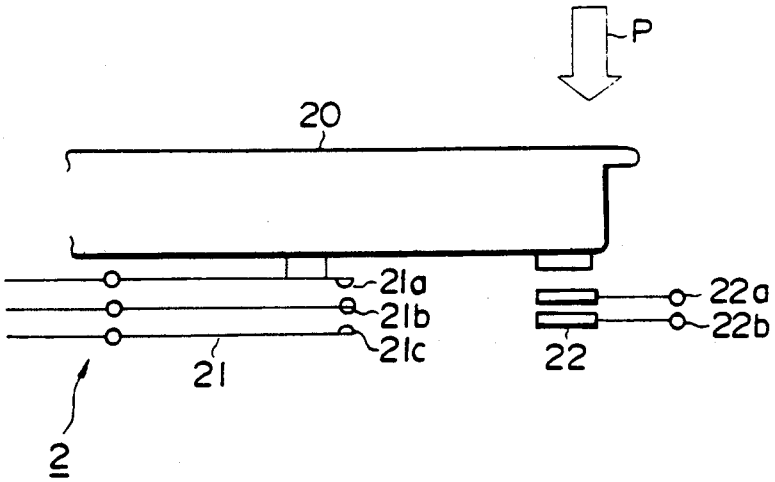
FIG. 2 is a diagram showing a specific example of a keyboard construction in the electronic musical instrument shown in FIG. 1.

A specific example of this device for detecting the state of key operation is shown in FIG. 2. For detecting a touch operation on a key 20, there are provided a key-on detection switch 21 for detecting an initial touch in the key depression and release operations and an after-touch sensor 22 for detecting an after-touch operation. The switch 21 has contacts 21*a*, 21*b* and 21*c* which constitute two stage contacts which are closed one after the other. In a key-on detection section 4 which constitutes the tone generation control means, time interval between closing of the contacts 21*a* and 21*b* and closing of the contacts 21*b* and 21*c* is detected as an initial touch upon depression of the key 20 among a plurality of keys in the keyboard 2 in the direction of an arrow P. In the key-on detection section 4, pressing force against the after-touch sensor 22 is detected as an after-touch. In response to the operation of the key. 20, a time signal representing the velocity of depressing the key 20 is obtained as initial touch data representing the initial touch by closing of the contacts 21*a*, 21*b* and 21*c* of the switch 21 whereas a pressure signal representing pressure applied to the key 20 is obtained from the after-touch sensor 22 as after-touch data representing the after-touch.

To the key-on detection section 4 is applied, as a control input, threshold value data ATTHL for the after-touch from a tone parameter setting and supply section 6 which constitutes the threshold value data setting means. In the key-on detection section 4, therefore, the state of depression of each key 20 in the keyboard 2 is watched and a key-on signal KON, a key-on pulse signal KONP, initial touch data IV, after-touch data AT and a key code KC are obtained.

In the tone parameter setting and supply section 6, not only the threshold value data ATTHL for the after-touch data to be supplied to the key-on detection section 4 but also various parameters concerning various tones to be generated are generated. These parameters are supplied to a tone generation section 8 which constitutes the tone generation means.

The tone generation section 8 generates a tone signal corresponding to the parameters supplied from the tone parameter setting and supply section 6 in accordance with the key-on signal KON, key-on pulse signal KONP, initial touch data IV, after-touch data AT and key code KC. In the tone generation section 8, a tone signal is generated from the time point of rising of the key-on pulse signal KONP with a tone volume level corresponding to the initial touch data IV and during the high level (H) section of the key-on signal KON and various level changes, modulation and sound effects are provided to the tone signal during its generation.

The tone signal generated in the tone generation section 8 is supplied to a sound system 10 for propagation therefrom as a sound.

According to the above construction, the two level signals which change from the high level (H) to the low level (L) are obtained one after the other upon depression of the key 20 in the keyboard 2 and the pressure signal is provided by the after-touch sensor 22 in response to the after-touch operation after the initial touch. The signals from the switch 21 and the after-touch sensor 22 are applied as control inputs to the key-on detection section 4 which, responsive thereto, produces the key-on signal KON, key-on pulse signal KONP, initial touch data IV, after-touch data AT and key code KC as tone generation control output signals.

The magnitude, or the amount of change, or the velocity of change, of the after-touch data AT is compared with the threshold value data ATTHL supplied from the tone parameter setting and supply section 6 and after-touch data AT exceeding the threshold value data ATTHL in the magnitude, the amount of change or the velocity of change thereof is obtained.

Parameters which the performer has designated in accordance with a piece of music to be played are set in the tone parameter setting and supply section 6. These parameters are supplied to the tone generating section 8 so that a tone signal corresponding to these parameters is controlled in response to the key-on signal KON, key-on pulse signal KONP, initial touch data IV, after-touch data AT and key code KC. In this case, the tone signal is controlled in response to the after-touch data AT in such a manner that, when the value of the after-touch data At has exceeded the threshold value ATTHL, a tone corresponding to the key operation is regenerated.

The tone signals generated in this manner by the tone generation section 8 are applied to the sound system 10 and the tone responsive to the initial touch is sounded first and the tone responsive to the after-touch operation is sounded subsequently.

By the regeneration of the tone responsive to the after-touch operation, a trill performance can be made readily in response to the after-touch operation after the initial touch of the key 20 without necessity for the stroke operation which repeats depression and release of the same key 20.

In rubbed string instruments such as a violin, special performances peculiar to the rubbed string instruments are made such, for example, as imparting of a rhythm with an accent by bowing when a tone of one note is played for a relatively long duration of time. According to the invention, such performances can be simulated easily by the after-touch operation by a simple key operation.

In a case where a rhythm tone source is used as the tone generation section 8, the first tone is generated by the key-on operation and, when the value corresponding to the after-touch operation detected during generation of the first tone has exceeded a predetermined value, the second tone imparting effects by changing rudiment of the first tone such as roll or flam is generated. By this arrangement, the performance effect can be improved in simulating a percussion sound by the multi-stage operation of one and the same key.

Figure 3:
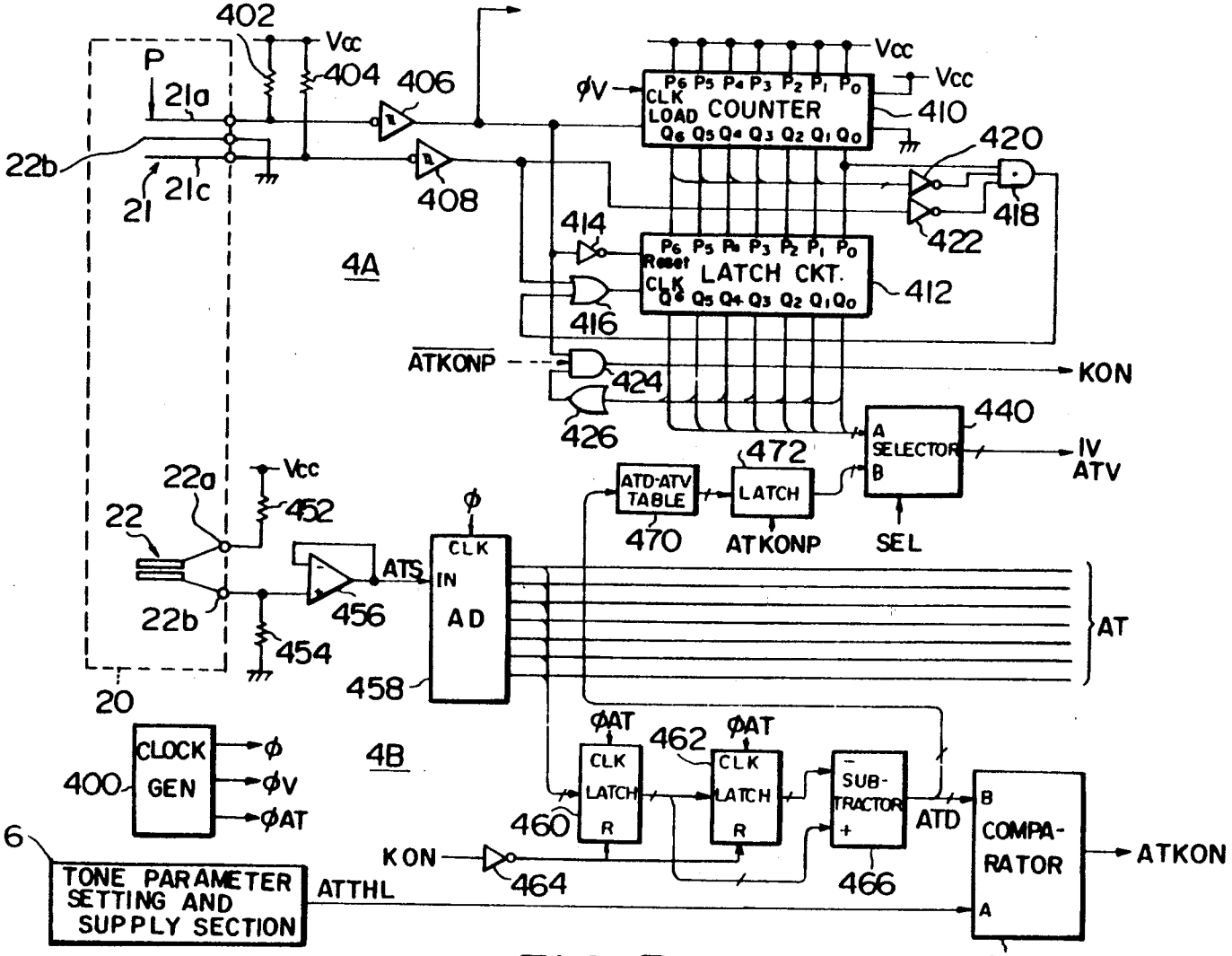
FIGS. 3 and 4 are circuit diagrams showing specific examples of the key-on detection section in the electronic musical instrument of FIG. 1.
Figure 4:
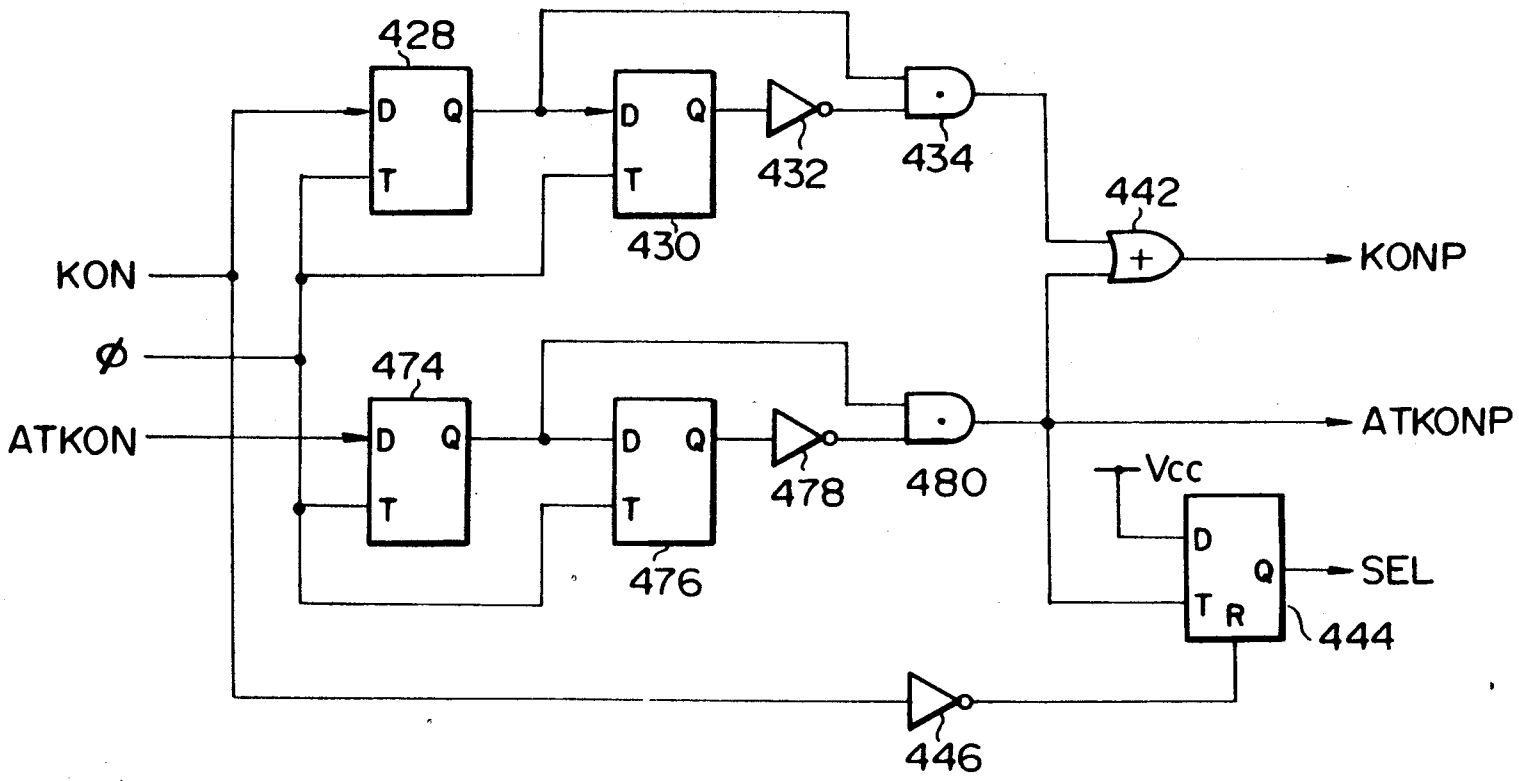

FIGS. 3 and 4 show examples of specific circuit constructions of the key-on detection section 4 shown in FIG. 1.

An initial touch detection section 4A and an after-touch detection section 4B are provided in the key-on detection section 4. The initial touch detection section 4A detects an initial touch upon depression of the key 20 and the after-touch detection section 4B detects the state of touch of the same key 20 after the initial touch. Description will be made hereinbelow in the order of (a) the initial touch detection section 4A, (b) the after-touch detection section 4B and (c) the operation of these sections 4A and 4B.

(a) The Initial Touch Detection Section 4A

Voltage Vcc is applied to the contacts 21*a* and 21*c* of the switch 21 provided under the key 20 and the intermediate contact 21*b* is grounded. When the key 20 is not depressed, i.e., when the contacts 21*a* and 21*c* are not closed against the contact 21*b*, the potentials at the contacts 21*a* and 21*c* are maintained at a high level (H) owing to the voltage Vcc. When the contact 21*a* has moved in the direction of the arrow P by depression of the key 20 to contact the contact 21*b*, the potential at the contact 21*a* drops to a low level (L) by grounding. When the contact 21*a* has further moved down to a point where the contact 21*b* contacts the contact 21*c*, the potential at the contact 21*c* drops to the low level (L) also by grounding. Thus, the initial touch of the key 20 is detected by conduction between the contacts 21*a* and 21*b* and conduction between the contacs 21*b* and 21*c* and the level signals corresponding to the key 20 are provided by the change in the level due to the conduction and non-conduction among the contacts 21*a*, 21*b* and 21*c*. The level signals are inverted through inverters 406 and 408 provided for the contacts 21*a* and 21*c* for subsequent logical operations.

As velocity detection means for detecting the velocity of depression of the key 20 from each level signal, a counter 410 and a latch circuit 412 are provided. The counter 410 consists, for example, of a 7-bit downcounter having preset inputs P0 to P6 receiving voltage Vcc, a clock input CLK receiving a velocity clock Φv and a load input LOAD receiving the output of the inverter 406. The counter 410 therefore performs downcounting from a 7-bit preset value "1111111" using the velocity clock Φv as a counting unit while the H level input from the inverter 406 holds and, as a result, 7-bit outputs Q0 to Q6 are obtained.

The latch circuit 412 consists, for example, of a 7-bit circuit corresponding to the counter 410 having preset inputs P0 to P6 receiving the outputs Q0 to Q6 of the counter 410, a reset input Reset receiving an inverted output of an inverter 414 and a clock input CLK receiving the output of an OR gate 416. To the OR gate 416 are applied outputs of the inverter 408 and an AND gate 418. The output Q0 of the least significant bit of the counter 410, inverted outputs of the other outputs Q1 to Q6 of the counter 410 through an inverter 420 and an inverted output of the inverter 408 through an inverter 422 are ANDed by the AND gate 418. Alternatively stated, when the output of the inverter 408 is at the L level, the outputs Q1 to Q6 other than the least significant bit output Q0 are at the L level and the output Q0 of the counter 410 is at the H level, the AND gate 418 is enabled.

The latch circuit 412 is reset when the output of the inverter 414 is switched to the L level and the outputs Q0 to Q6 of the counter 410 are latched in response to the output of the H level from the inverter 408 or the output of the H level of the AND gate 418 applied through the OR gate 416. The outputs Q0 to Q6 of the latch circuit 412 represent time interval between closing of the contacts 21*a* and 21*b* and closing of the contacts 21*b* and 21*c*, i.e., the velocity of depressing the key 20 corresponding to the initial touch. The outputs Q0 to Q6 of the latch circuit 412 are delivered out as initial touch data IV through a selector 440. The selector 440 selects either an input A or B to be delivered out in response to a selection signal SEL. During the initial touch, the selection signal SEL becomes the L level and the input A is selected.

If the velocity of depressing the key 20 is very low, the AND gate 418 is enabled and an output of the H level is provided from the AND gate 418 at a time point when the count of the counter 410 has become "1" so that this count "1" of the counter 410 is latched by the latch circuit 412. This output of the latch circuit 412 also is delivered out as the initial touch data IV through the selector 440.

Applied to an AND gate 424 is the output of the inverter 406 and the outputs Q0 to Q6 of the latch circuit 412 through an OR gate 426 and the AND gate 424 is enabled by these outputs. The AND gate 424 therefore is enabled when the output of the inverter 406 is at the H level and any bit of the outputs Q0 to Q6 of the latch circuit 412 is at the H level so that upon closing of the contacts 21*a* and 21*b* and closing of the contacts 21*b* and 21*c*, the level signal from the inverter 406 representing the key-on state from start of depression of the key 20 to release thereof is provided as the key-on signal KON. The AND gate 424 receives as one of its inputs each bit of the outputs Q0 to Q6 of the latch circuit 412. This is an arrangement for synchronizing timing of generation of the key-on signal KON and the initial touch data IV.

The key-on signal KON is applied to a data input D of a flip-flop 428 in a logic circuit shown in FIG. 4. A flip-flop 430 is serially connected to the posterior stage of the flip-flop 428. To each timing input T of these flip-flops 428 and 430 is applied a basic operation clock Φ from a clock generation section 400 shown in FIG. 3. An output Q of the flip-flop 430 is inverted by an inverter 432 and this inverted output and an output Q of the flip-flop 428 are applied to an AND gate 434 and ANDed by it. The output of the AND gate 434 is applied to an OR gate 442 to constitute a part of the key-on pulse signal KONP.

(b) After-Touch Detection Section 4B

The after-touch sensor 22 provided under the key 20 consists of a pressure sensitive element which generates an electric signal in response to pressure applied thereto. A voltage Vcc is applied to a terminal 22*a* of the sensor 22 through resistance 452 and a terminal 22*b* of the sensor 22 is grounded through resistance 454. An electric signal produced in the after-touch sensor 22 is provided as an after-touch detection signal ATS through the resistance 454 and an amplifier 456. This after-touch detection signal ATS is applied to an analog-to-digital converter 458 and converted therein to a 7-bit digital signal in response to the basic operation clock Φ applied from the clock generation section 400 to the clock input CLK. This digital signal is provided as the after-touch data AT.

Cascade-connected latch circuits 460 and 462 are connected on the output side of the analog-to-digital converter 458. To each clock input CLK of the latch circuits 460 and 462 is applied an after-touch sampling clock ΦAT from the clock generation section 400 and to each reset input R of these circuits 460 and 462 is applied the key-on signal KON through an inverter 464. Accordingly, after resetting by the key-on signal KON, the after-touch data AT is sampled in response to the after-touch sampling clock ΦAT in the latch circuits 460 and 462 and current after-touch data is held in the latch circuit 460 whereas preceding after-touch data AT which was held in the latch circuit 460 before renewal is held in the latch circuit 462. A subtraction circuit 466 is provided on the output side of the latch circuits 460 and 462. In the subtraction circuit 466, the after-touch data AT of the latch circuit 462 applied to the negative input (−) of the subtraction circuit 466 is subtracted from the after-touch data AT of the latch circuit 460 applied to the positive terminal (+) of the subtraction circuit 466 whereby after-touch change value data ATD representing change, i.e., velocity of change, in the after-touch data AT during one period of the after-touch sampling clock Φ AT is obtained.

The after-touch change value data ATD is applied to a B input of a comparator 468 and compared therein with the threshold value data ATTHL for the after-touch change value data ATD set by the tone parameter setting and supply section 6 and applied to an A input of the comparator 468. When the after-touch change value data ATD has exceeded the threshold value data ATTHL (A<B), the comparator 468 produces an after-touch key-on signal ATKON representing a period of time of key-on by the after-touch just as the key-on signal KON produced immediately upon depression of the key 20.

The after-touch change value data ATD obtained by the subtraction circuit 466 is applied also to an after-touch change value data (ATD)-to-after-touch velocity data (ATV) conversion table 470 and is converted therein to corresponding after-touch velocity data ATV. This after-touch velocity data ATV is latched by a latch circuit 472 in response to an after-touch key-on pulse signal ATKONP produced by an AND gate 480 of FIG. 4 and thereafter is applied to the input B of the selector 440. This velocity value is provided by the selector 440 as after-touch velocity data ATV for regeneration of a tone in the after-touch operation.

The after-touch key-on signal ATKON is applied to a data input D of a flip-flop 474 of the logic circuit shown in FIG. 4. A flip-flop 476 is serially connected at the posterior stage of the flip-flop 474. The basic operation clock Φ from the clock generation section 400 shown in FIG. 3 is applied to each timing input T of the flip-flops 474 and 476. The output Q of the flip-flop 476 is inverted by an inverter 478 and this inverted output and the output Q of the flip-flop 474 are applied to an AND gate 480 and ANDed thereby. The output of this AND gate 480 is ORed with the output of the AND gate 434 by an OR gate 442 and is provided as the key-on pulse signal KONP and also is provided directly as the after-touch key-on pulse signal ATKONP.

The output of the AND gate 480 is applied to a timing input T of a flip-flop 444 provided for forming the selection signal SEL to be supplied to the selector 440. In this flip-flop 444, a data input D is pulled up to voltage Vcc and an inverted signal of the key-on signal KON is applied through an inverter 446 to a reset input R. This flip-flop 444 therefore is reset when its reset input R has been turned to the L level and its output Q which constitutes the selection signal SEL is turned to the H level when the output of the AND gate 480 at the timing input T has been turned to the H level. When this selection signal SEL has been turned to the H level, the selector 440 selects the input B and outputs the after-touch velocity data ATV corresponding to the after-touch key-on pulse signal ATKONP.

(c) Operation

Upon depression of the key 20, the counter 410 counts down the velocity clock Φv starting from conduction between the contacts 21*a* and 21*b* of the switch 21 and the count of the counter 410 at the time point of conduction between the contacts 21*b* and 21*c* of the switch 21 is latched by the latch circuit 412. The outputs Q0 to Q6 of the latch circuit 412 are provided through the selector 440 as the initial touch data IV.

Figure 5:
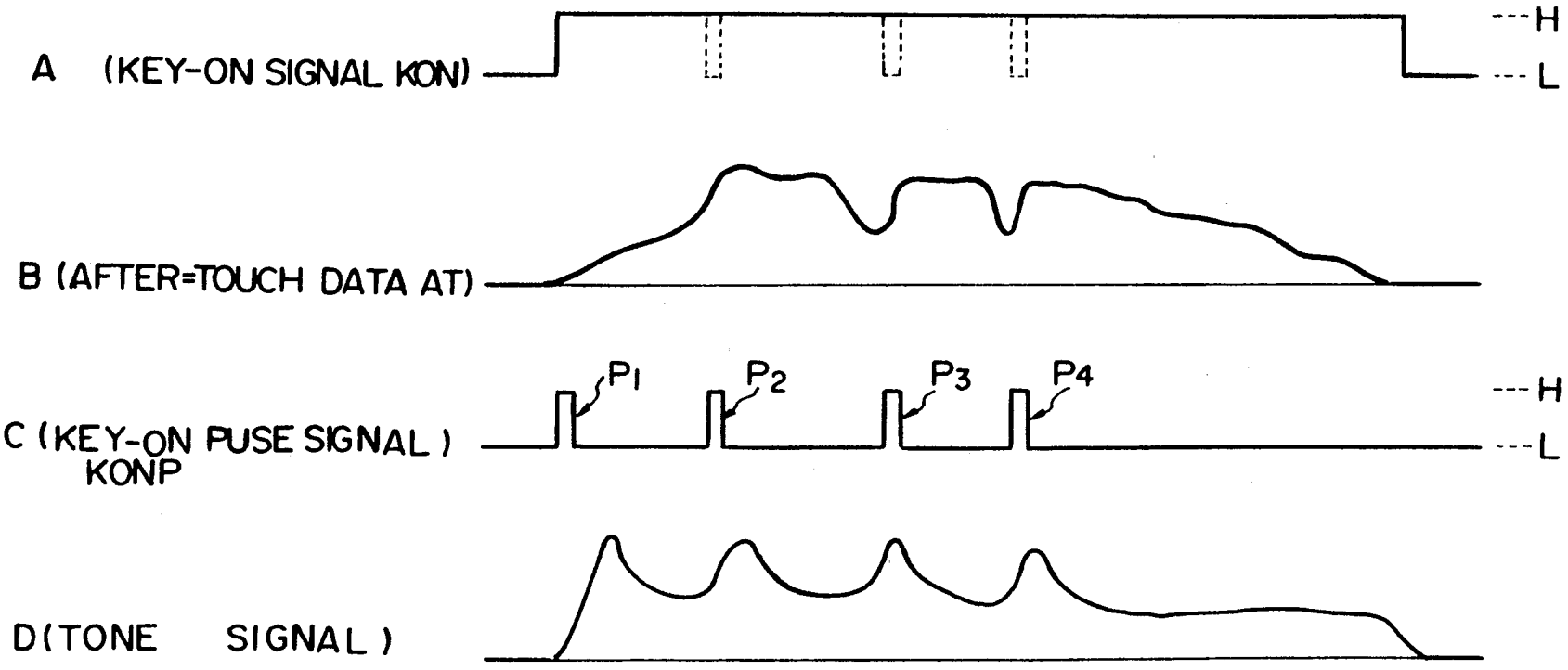
FIG. 5 is a waveform diagram for explaining the operation of the electronic musical instrument.

Since, at this time, the outputs Q0 to Q6 of the latch circuit 412 and the output of the H level of the inverter 406 representing conduction between the contacts 21*a* and 21*b* are ANDed by the AND gate 424, the key-on signal KON representing that the key 20 is being depressed is obtained as shown by A in FIG. 5. This key-on signal KON is applied to an OR gate 442 through the flip-flops 428 and 430, the inverter 432 and the AND gate 434 in the logic circuit of FIG. 4.

As the performer performs the after-touch operation, i.e., as he further depresses the key 20 after the initial touch, the after-touch sensor 22 produces the after-touch detection signal ATS representing the magnitude of the after-touch pressure or the velocity of the after-touch. This after-touch detection signal ATS is converted to digital data by the analog-to-digital converter 458. This digital after-touch data AT represents, as shown in B in FIG. 5, the level corresponding to the after-touch operation by the performer.

This after-touch data AT is sampled by the after-touch sampling clock ΦAT and latched by the latch circuit 460 and the after-touch data AT previously latched by the latch circuit 462 is transferred to the latch circuit 462 in synchronism with the after-touch sampling clock ΦAt. As a result, current after-touch data ATa is held by the latch circuit 460 and after-touch data ATb which existed one cycle of the after-touch sampling clock ΦAT before is held by the latch circuit 462. The subtraction circuit 466 subtracts the after-touch data ATb from the after-touch data ATa whereby the after-touch change value data ATD during one period of the after-touch sampling clock ΦAT is obtained.

This after-touch change value data ATD is compared with the threshold value data ATTHL from the tone parameter setting and supply section 6 by the comparator 468 and, when the after-touch change value data ATD has exceeded the threshold value data ATTHL, the after-touch key-on signal ATKON is provided by the comparator 468 as the key-on signal in the after-touch operation.

This after-touch key-on signal ATKON is applied to the flip-flop 474 of the logic circuit of FIG. 4 and the after-touch key-on pulse signal ATKONP is thereupon provided from the AND gate 480 through the flip-flop 476, inverter 478 and AND gate 480. Simultaneously, the signal ATKON is ORed with the output of the AND gate 434 by the OR gate 442 and the key-on pulse signal KONP is provided from the OR gate 442. This key-on pulse signal KONP rises, as shown in C of FIG. 5, immediately upon depression of the key 20 and thereafter in response to sharp change in the after-touch data AT shown in B of FIG. 5 and falls with a certain pulse width. P1 is a pulse produced immediately upon depression of the key 20 and P2 to P4 are pulses produced by the after-touch operation.

The after-touch change value data ATD provided by the subtraction circuit 466 is applied to the ATD-ATV conversion table 470 and converted to the after-touch velocity data ATV and thereafter is latched by the latch circuit 472 in response to the after-touch key-on pulse signal ATKONP and applied to the selector 440. When the after-touch key-on pulse signal ATKONP has been provided, the output of the selector 440 is switched to the input B in response to the selection signal SEL so that the after-touch velocity data ATV for regeneration of a tone in the after-touch operation is produced. By performing the after-touch operation after the initial touch operation on the key 20, therefore, the initial touch data IV representing the state of the initial touch operation and the after-touch velocity data ATV representing the state of the after-touch operation after the initial touch are successively provided.

The output of the inverter 406 is applied to a key code generation circuit (not shown) for producing the key code KC corresponding to the depressed key.

By the above described key-on detection operations, the key-on detection section 4 provides the data including the key-on signal KON, key-on pulse signal KONP, initial touch data IV, after-touch velocity data ATV, after-touch data AT and key code KC. These data are applied to the tone generation section 8 as tone control signals.

In the tone generation section 8, a tone signal is produced in response to the data including the key-on signal KON, key-on pulse signal KONP and initial touch data IV and a tone signal by the after-touch operation is generated again in response to the data including the key-on pulse signal KONP, after-touch velocity data ATV and after-touch data AT. Accordingly, a tone signal is first generated in response to the initial touch and then tone signal for the same key 20 are regenerated when an operation on the key 20 has been performed in such a manner that the after-touch has exceeded a predetermined value, i.e., the threshold value data ATTHL from the tone parameter setting and supply section 6. As a result, as shown in D of FIG. 5, the tone signal produced by the initial touch and the tone signals produced by the after-touch are supplied one after another to the sound system whereby the tone by the initial touch is sounded and thereafter the tones by the after-touch are sounded.

If, as shown by a broken line at the AND gate 424 of the initial touch detection section 4A, an inverted signal $\overline{\text{ATKONP}}$ of the after-touch key-on pulse signal ATKONP is applied to the AND gate 424 to enable it to produce the key-on signal KON, the key-on signal KON can be caused to drop to the L level during the H level periods of the after-touch key-on signal ATKONP as shown by a broken line in A of FIG. 5 whereby the key-on signal KON is produced intermittently to control tone generation accordingly.

Figure 6:
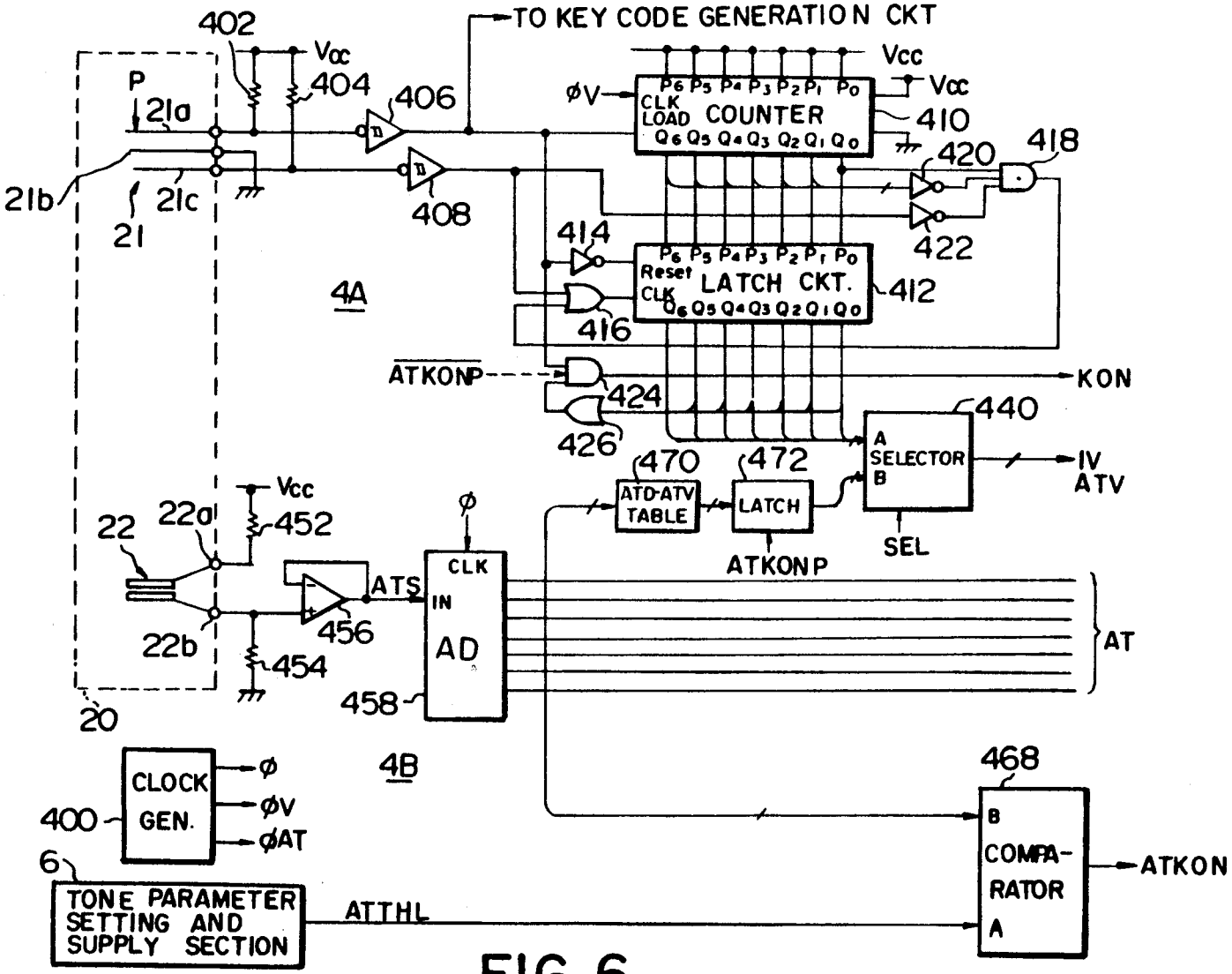
FIG. 6 is a circuit diagram showing another example of the after-touch detection section in the key-on detection section of FIG. 3.

FIG. 6 shows another specific example of the after-touch detection section 4B in the key-on detection section 4 in FIG. 3.

In the after-touch detection section 4B in the key-on detection section 4 shown in FIG. 3, the latch circuits 460 and 462 and the subtraction circuit 466 are provided to obtain the after-touch change value data ATD as the state of the after-touch operation and this data ATD is used for forming of the after-touch key-on signal ATKON and the after-touch velocity data ATV so that a tone in the after-touch operation is regenerated when the velocity of change in the after-touch has exceeded the threshold value. In the example of FIG. 6, a tone in the after-touch operation is regenerated when the value of the after-touch data AT itself has exceeded a threshold value. That is, in the example of FIG. 6, the example of latch circuits 460 and 462 and the subtractor 466 are omitted from the after-touch detection section 4B of FIG. 3 and the after-touch key-on signal ATKON and the after-touch velocity data ATV are formed from the after-touch data AT provided from the analog-to-digital converter 458. To the input B of the comparator 468 is applied directly the after-touch data AT provided by the analog-to-digital converter 458 and the after-touch key-on signal ATKON is produced by comparison of the after-touch data AT with the threshold value data ATTHL. By storing after-touch velocity data ATV corresponding to the after-touch data AT in the ATD-ATV conversion table 470, the after-touch velocity data ATV can be obtained in correspondence to the after-touch data AT and this after-touch velocity data ATV can be provided from the selector 440.

A tone based on the after-touch operation can be regenerated in response to the after-touch key-on signal ATK and the after-touch velocity data ATV.

Alternatively, the after-touch data AT of this example and the velocity of change in the after-touch data AT may be combined to control regeneration of a tone based on the after-touch.

Referring to FIGS. 3, 4 and 6, description has been made about the key-on detection section 4 about a single key 20 has been made. In some electronic musical instruments such as keyboard type electronic musical instruments which require a large number of keys, the initial touch detection section 4A and the after-touch detection section 4B may be provided for each key.

In the above described embodiments, the key-on detection section 4 is constructed of a hardware but this may be constructed in combination with a software by using a microcomputer.

For detection of the after-touch operation, detection signals from after-touch sensors 22 provided for respective keys 20 may be provided on a time shared basis and these signals may be analog-to-digital converted for further processings. By this arrangement, complexity which would otherwise be involved in detecting the after-touch operation in an electronic musical instrument having a large number of keys will be eliminated.

In an electronic musical instrument for generating rhythms, the invention may be applied in such a manner that, when the after-touch data AT or the velocity of change in the after-touch data AT has exceeded a predetermined value, the corresponding rhythm tone may be brought to the state of roll or the manner of performance such as tempo or rhythm pattern may be changed.

The invention is also applicable to a performance instrument other than a keyboard type electronic musical instrument, for example, a sound generating pad in a rhythm forming electronic musical instrument.

Some delay time may be provided after depression of a key and the value of after-touch may be watched during this delay time so that a tone generated by key-on immediately after a very strong depression of the key and a tone generated by the after-touch operation will not overlap each other.

What is claimed is:

1. An electronic musical instrument comprising:

a plurality of keys;

key-on information generation means associated with said keys for generating key-on information indicating depression of one of said keys;

after-touch information generation means associated with said keys for generating after-touch information representing the state of a key operation subsequent to an initial touch on said key while the key is still depressed;

tone generation mean for generating a tone signal corresponding to said key in response to the key-on information; and tone generation control means for (a) generating a tone start signal in response to the key-on information for causing the tone generation means to start generation of a tone and (b) subsequently generating at least one additional tone start signal in response to the after touch information for causing the tone generation means to again start generation of a subsequent tone and impart at least one characteristic to the subsequently generated tone in accordance with the after touch information.

2. An electronic musical instrument as defined in claim 1 wherein said tone generation control means comprises:

threshold value data setting means for setting threshold value data for the after-touch information;

comparison means for comparing the threshold value data set by said threshold value data setting means with the after-touch information; and tone controller means for producing a tone start signal which is forwarded to the tone generation means to again start generation of a tone based on said depressed key in accordance with a result of the comparison by said comparison means.

3. An electronic musical instrument as defined in claim 2 wherein said key-on information generation means comprises initial touch data generation means for generating initial touch data representing the state of the initial touch on said key and said tone controller means comprises selection means for selecting either the initial touch data or the after-touch information, in response to the result of comparison by said comparison means, for forwarding a signal imparting a characteristic to be imparted on the subsequently generated tone.

4. An electronic musical instrument as defined in claim 2 wherein said tone generation control means further comprises after-touch change value data generation means for generating after-touch change value data representing change in the after-touch information during a predetermined period of time and said comparison means compares this after-touch change value data with the threshold value data.

5. An electronic musical instrument as defined in claim 4 wherein said after-touch change value data generation means generates the after-touch change value data by obtaining the difference between current after-touch information and after-touch information at a time point a predetermined period of time before, to produce an after-touch rate of change signal.

6. An electronic musical instrument as defined in claim 3 wherein said tone controller means produces the tone start signal based on said key when the after-touch information has exceeded the threshold value in said comparison means.

* * * * *